US006575508B2

(12) United States Patent
Stuart et al.

(10) Patent No.: US 6,575,508 B2
(45) **Date of Patent: *Jun. 10, 2003**

(54) HANDLE WITH UNIDIRECTIONAL COUNTERWEIGHT

(75) Inventors: David R. Stuart, Middleview, MI (US); Michael Biirsna, Grandville, MI (US)

(73) Assignees: ADAC Plastics, Inc., Grand Rapids, MI (US); Ford Motor Company, Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/794,549

(22) Filed: Feb. 27, 2001

(65) Prior Publication Data

US 2001/0035656 A1 Nov. 1, 2001

Related U.S. Application Data

(63) Continuation-in-part of application No. 09/552,845, filed on Apr. 21, 2000.

(51) Int. Cl.[7] ..... E05B 3/00

(52) U.S. Cl. ..... 292/336.3; 292/DIG. 23; 292/347; 292/DIG. 22

(58) Field of Search ..... 292/336.3, 344, 292/DIG. 22, DIG. 65, DIG. 23, 216

(56) References Cited

U.S. PATENT DOCUMENTS

| | | | | | |
|---|---|---|---|---|---|
| 3,583,741 | A | | 6/1971 | Breitschwerdt et al. | |
| 3,719,248 | A | | 3/1973 | Breitschwerdt et al. | |
| 3,799,596 | A | * | 3/1974 | Nozomu et al. | 292/216 |
| 3,990,531 | A | | 11/1976 | Register | |
| 4,536,021 | A | * | 8/1985 | Mochida | 292/201 |
| 4,580,822 | A | * | 4/1986 | Fukumoto | 292/336.3 |
| 5,092,642 | A | | 3/1992 | Lindmayer et al. | |
| 5,308,130 | A | | 5/1994 | Lee | |
| 5,431,462 | A | | 7/1995 | Lignell | |
| 5,560,659 | A | | 10/1996 | Dault | |
| 5,669,642 | A | | 9/1997 | Kang | |
| 5,769,471 | A | | 6/1998 | Suzuki et al. | |
| 6,007,122 | A | * | 12/1999 | Linder et al. | 292/336.3 |
| 6,010,167 | A | | 1/2000 | Tanimoto et al. | |
| 6,042,159 | A | | 3/2000 | Spitzley | |
| 6,099,052 | A | | 8/2000 | Spitzley | |
| 6,241,294 | B1 | * | 6/2001 | Young et al. | 292/336.3 |

* cited by examiner

*Primary Examiner*—Gary Estremsky
(74) *Attorney, Agent, or Firm*—Young & Basile P.C.

(57) ABSTRACT

A motor vehicle door handle assembly combining the use of a counterweight to preclude inadvertent opening movement of the door in a side impact scenario and the ability to install the handle assembly from outside of the vehicle by passing the handle assembly through an aperture in an outer skin of the door. The handle assembly includes a housing; a handle mounted for opening and closing movement on the housing; an actuator mechanism operative in response to opening movement of the handle to unlatch a latch mechanism of the door and allow opening of the door; and a counterweight. The counterweight is mounted on the housing for movement between an installation position within a profile of the housing, to facilitate installation of the handle assembly in a motor vehicle door by insertion of the handle assembly through an aperture in an outer skin, and an operative position in juxtaposition to the actuator mechanism in which it is operative in response to an impact against the side of the vehicle proximate the door handle assembly to resist movement of actuator mechanism in a door unlatching direction. The counterweight in its operative position pushes against the actuator mechanism, so as to resist inadvertent movement of the actuator mechanism in a door unlatching direction in response to an impact against the vehicle proximate the door handle assembly, but is free to move away from the actuator mechanism so as not to act to urge the actuator mechanism in a door unlatching direction in response to an impact against the side of the vehicle remote from the door handle assembly.

7 Claims, 6 Drawing Sheets

FIG - 1
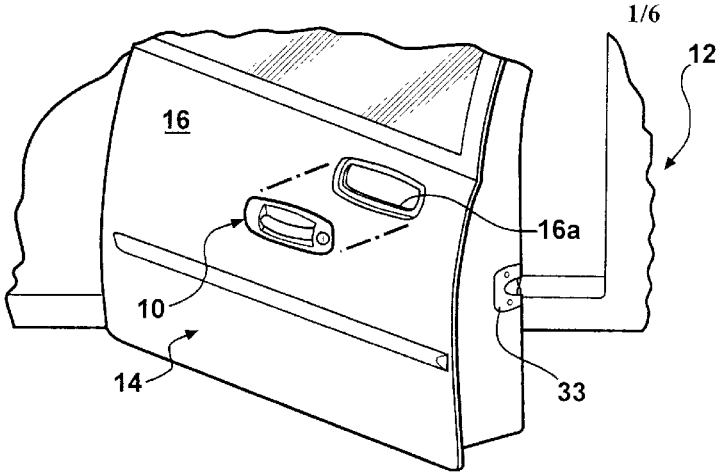
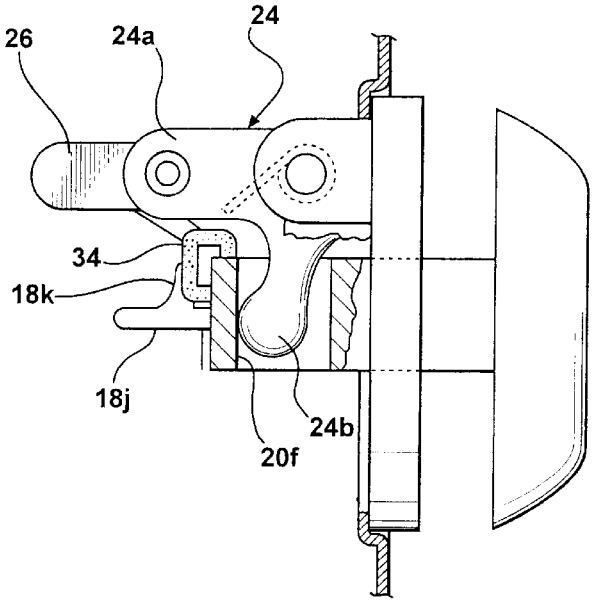
FIG - 2
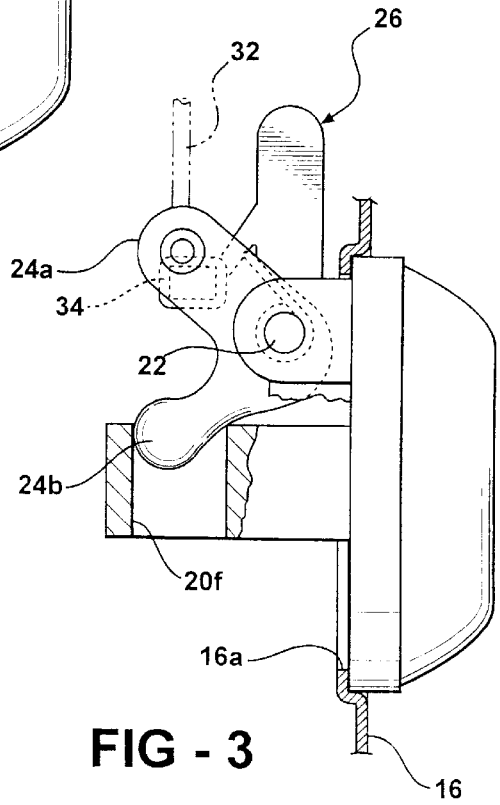
FIG - 3

HANDLE WITH UNIDIRECTIONAL COUNTERWEIGHT

RELATED APPLICATION

This application is a continuation-in-part of U.S. patent application Ser. No. 09/556,845 filed on Apr. 21, 2000.

FIELD OF THE INVENTION

This invention relates to handle assemblies and more particularly to handle assemblies for controlling the latch mechanisms on motor vehicle doors.

BACKGROUND OF THE INVENTION

Vehicle doors typically include a latch mechanism for latching and unlatching the door to the vehicle body, a handle assembly positioned on the door and operative to control the latch mechanism, and a lock mechanism to selectively render the handle assembly effective or ineffective to operate the latch. It is imperative that side impact against the vehicle, resulting for example from a collision, not result in the inadvertent movement of the handle of the handle assembly to a latch release position with consequent movement of the latch to an unlatched position and consequent inadvertent opening of the door. This in general is not a problem when the door is locked since in this case the door handle is either precluded from movement by the lock mechanism or the door handle is allowed to freewheel to its unlatched position but this movement is ineffective to move the latch to its unlatched position. However, when the door is unlocked, as is most typically the case in an operating vehicle, side impact can easily result in inertial movement of the door handle to its unlatched position with consequent unlatching of the latch mechanism, consequent opening of the door, and consequent discharge of unbuckled vehicle passengers from the vehicle.

Various attempts have been made to prevent such inadvertent opening of the door in a side impact. One such attempt has involved the use of a counterweight which forms a part of the door handle assembly and which is incorporated in the actuator mechanism of the door handle assembly in such a way as to resist inadvertent door opening movement of the actuator mechanism in a side impact scenario. Such use of a counterweight in the door handle assembly to preclude inadvertent door opening has been generally effective. However, the prior art counterweight arrangements, while resisting inadvertent door opening movement in a side impact against a side of the vehicle proximate the door handle assembly, have tended to contribute to inadvertent door opening in response to impacts against other aspects of the vehicle, such, for example, as a side of the vehicle remote from the door handle assembly. Further, it is desirable in many installation situations to install the door handle assembly from outside of the vehicle by inserting the door handle assembly through an aperture in the outer skin of the vehicle door and, in this scenario, the counterweight, which typically projects beyond the profile of the housing of the door handle assembly, complicates and/or precludes installation of the door handle assembly through the aperture in the outer skin of the door and dictates the use of more complicated and more expensive installation techniques.

SUMMARY OF THE INVENTION

This invention is directed to an improved door handle assembly.

More specifically, this invention is directed to a vehicular door handle apparatus and methodology that operates to discourage inadvertent opening of the door in the event of an impact against a side of the vehicle proximate the handle assembly and which does not encourage inadvertent opening of the door in response to impacts against other aspects of the vehicle.

Yet more specifically, this invention is directed to a vehicular door handle apparatus and methodology that operates to resist inadvertent opening of the door in side impact scenarios and which allows the insertion of the door handle assembly through an aperture in the outer skin of the door to simplify installation.

The door handle assembly of the invention is intended for controlling the latch of a motor vehicle door and includes a housing, a handle mechanism mounted on the housing for movement in an unlatching direction and in an opposite latching direction, and a counterweight.

According to the invention apparatus and methodology, the counterweight is operative to generate a force resisting movement of the handle assembly in an unlatching direction and inoperative to generate a force resisting movement of the handle mechanism in a latching direction. This arrangement allows the counterweight to resist opening movement of the handle in response to an impact against a side of the vehicle proximate the handle assembly while not contributing to inadvertent door opening movement in response to an impact against the side of the vehicle remote from the handle assembly.

According to a further feature of the invention apparatus and methodology, the counterweight is arranged to push against the handle mechanism rather than being fixed for movement with the handle mechanism. With this arrangement, the counterweight may push against the handle mechanism to resist opening movement of the handle mechanism in response to an impact against a side of the vehicle proximate the handle assembly but is free to move away from the handle mechanism in response to impacts against aspects of the vehicle remote from the handle assembly so as not to act to urge the handle mechanism in a door unlatching direction.

According to a further feature of the invention, the counterweight is coupled for movement with the handle mechanism in response to movement of the handle mechanism in an unlatching direction and is free to move independently of the handle mechanism in response to movement of the handle mechanism in a latching direction. This arrangement, again, allows the counterweight to resist unlatching movement of the handle mechanism in response to an impact against a side of the vehicle proximate the handle assembly while being free to separate from the handle mechanism in response to impacts against aspects of the vehicle remote from the handle assembly so as not to urge the handle mechanism in a door unlatching direction.

According to a further feature of the invention, the handle mechanism comprises a handle and an actuator lever mounted for movement about a pivot axis; the counterweight is mounted for pivotal movement about the pivot axis; and the handle assembly includes biasing means operative to push the counterweight against the actuator lever. This arrangement provides a simple and effective means for allowing the counterweight to resist movement of the handle mechanism in an unlatching direction while not interfering with movement of the handle mechanism in a latching direction.

According to a further feature of the invention, the biasing means comprises a return coil spring positioned on the pivot axis and operative to yieldably resist opening movement of the handle mechanism and further urge the counterweight for pivotal movement against the actuator lever. This arrangement allows the existing return coil spring of the door handle assembly to be used to provide the biasing force to push the counterweight against the actuator lever.

According to a further feature of the invention, the actuator lever comprises a bell crank lever having a first arm driven by the handle and a second arm connected to the latch mechanism of the door whereby opening movement of the handle unlatches the door and the biasing means acts to bias the counterweight against the second arm of the bell crank lever. This arrangement allows the counterweight of the invention to operate in cooperation with the bell crank actuator lever typically found in a motor vehicle door handle assembly.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 1 is a fragmentary view of a motor vehicle schematically illustrating the installation of the door handle assembly in the motor vehicle door;

FIG. 2 is a view showing the installation of the door handle assembly by passing the door handle assembly through an aperture in the vehicle door;

FIG. 3 is a view showing the completed installation of the door handle assembly in the vehicle door;

DESCRIPTION OF THE PREFERRED EMBODIMENT

Figure 4:
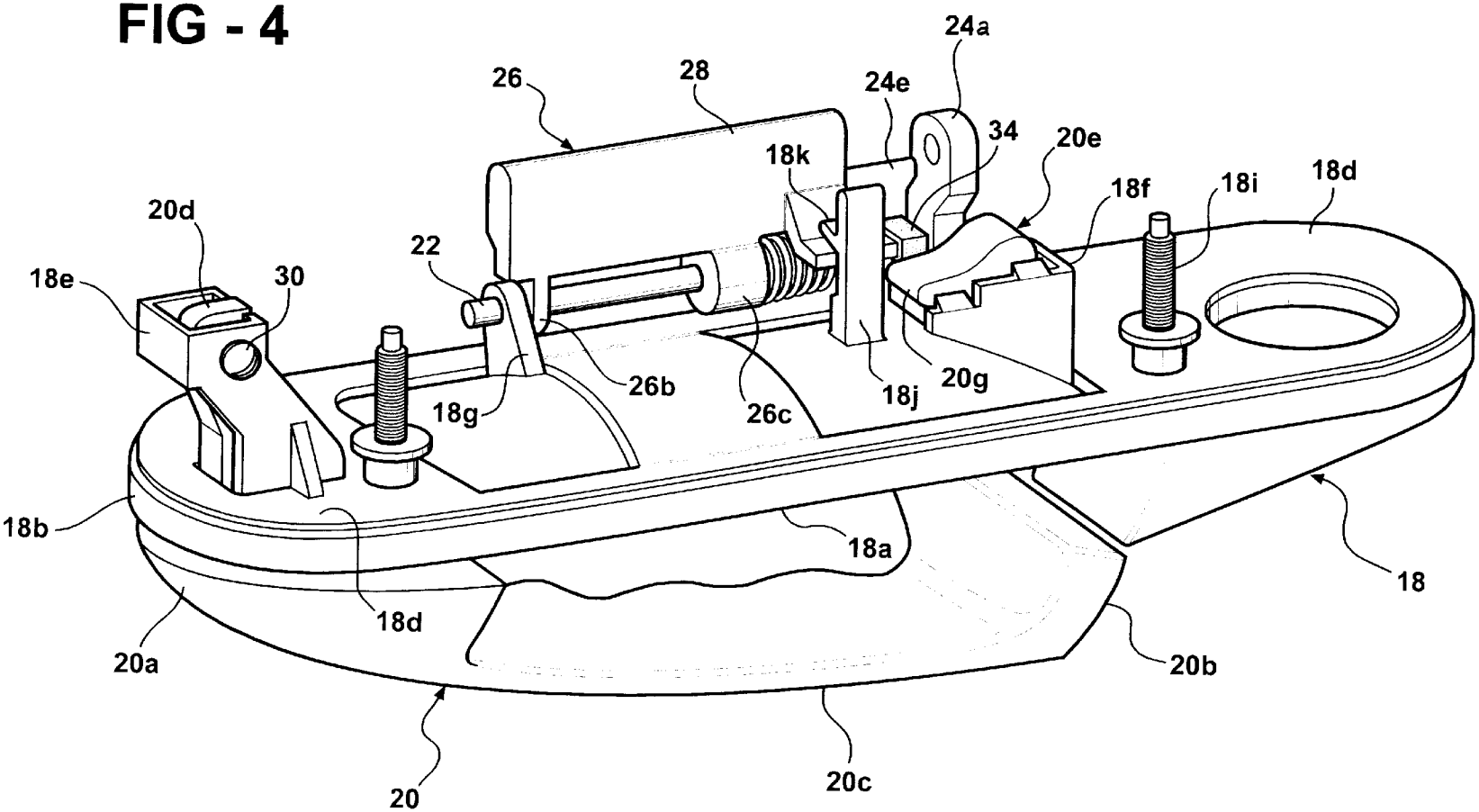
FIG. 4 is a perspective view showing the handle assembly with a counterweight in an installation position.

The handle assembly 10 of the invention is seen in FIG. 1 in association with a fragmentarily shown motor vehicle 12 including a door 14, an outer door skin 16, and an aperture 16*a* in the door skin for passage and mounting of the door handle assembly.

The door handle assembly of the invention (FIGS. 2–7) includes a housing 18, a handle 20, a pivot shaft 22, an actuator lever in the form of a bell crank lever 24, a counterweight 26, and a coil spring 28. All of the parts may be formed of any suitable material, such for example as a suitable plastic or suitable metallic material, and may be formed in any suitable forming operation.

Figure 8:
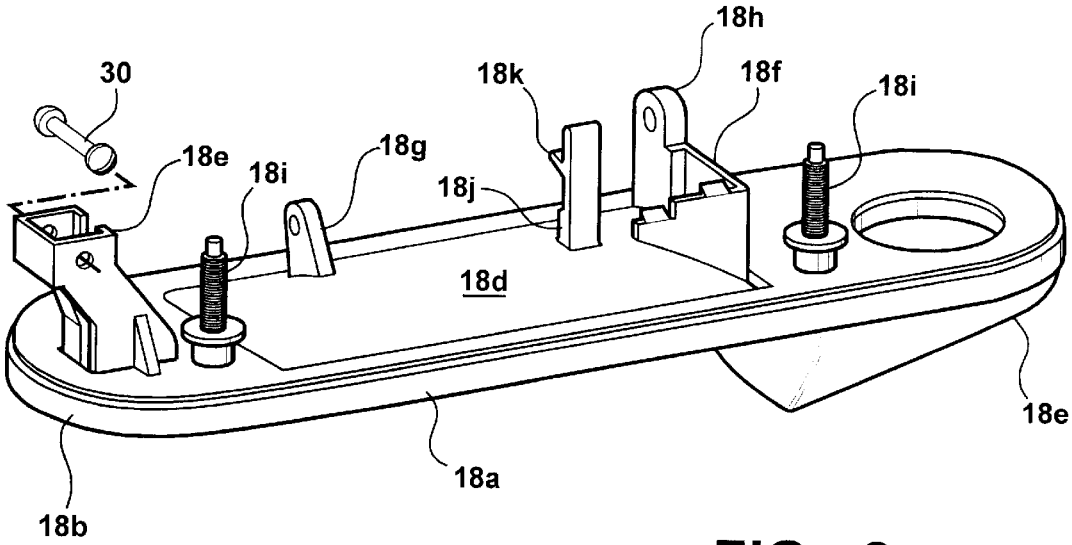
FIG. 8 is a perspective view of the housing of the handle assembly.
Figure 6:
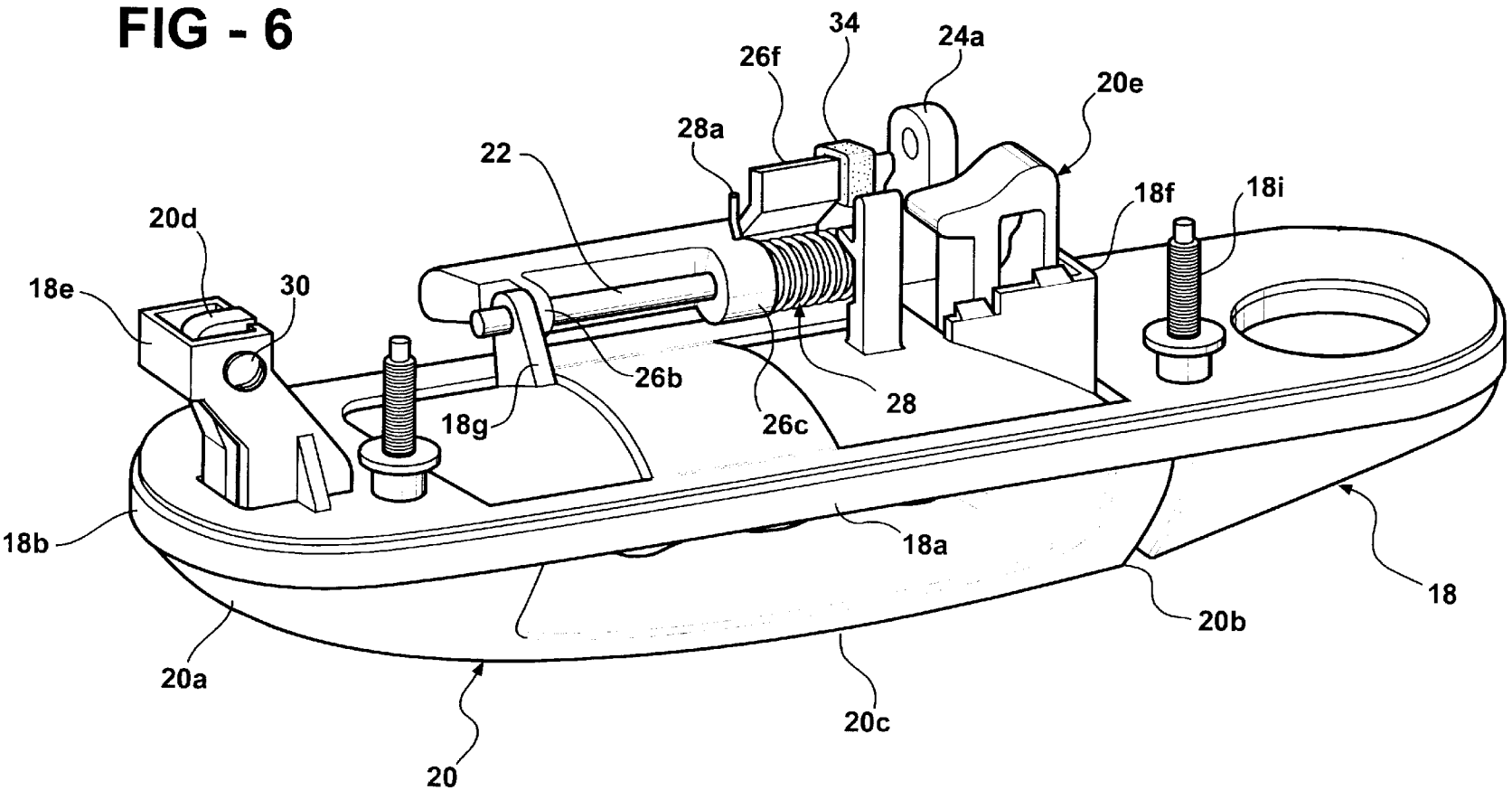
FIG. 6 is a perspective view of the handle assembly with the counterweight in an operative position.
Figure 7:
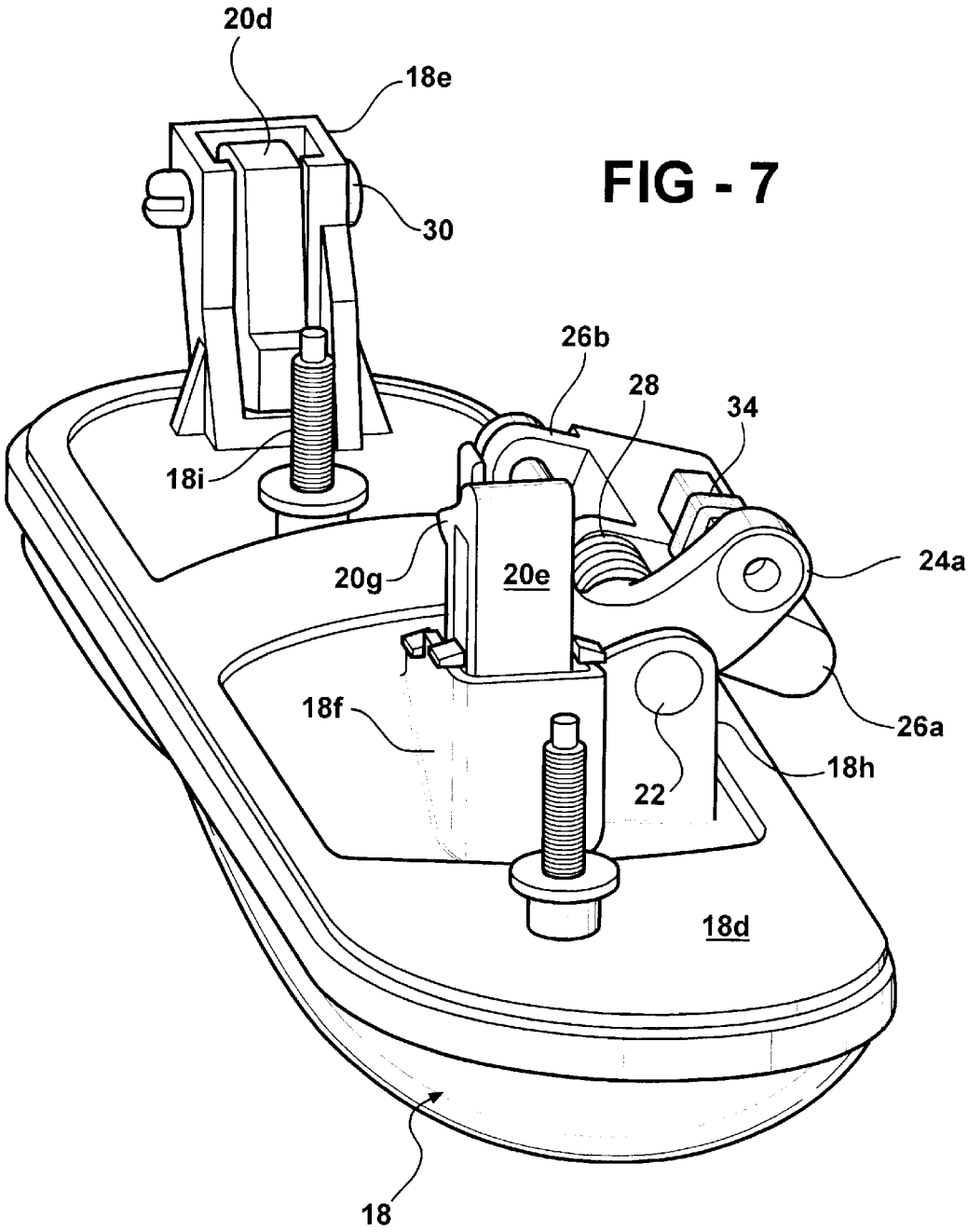
FIG. 7 is a further perspective view of the handle assembly with the counterweight in its operative position.

Housing 18 (FIG. 8) has a generally oblong oval configuration and includes a main body portion 18*a*, a front end 18*b*, a rear end 18*c*, an inner face 18*d*, a pivot structure 18*e* upstanding from inner face 18*d* proximate front end 18*b*, a guide structure 18*f* upstanding from inner face 18*d* proximate rear end 18*c*, a front lug 18*g*, a rear lug 18*h* formed integrally with guide structure 18*f*, front and rear fasteners 18*i* upstanding from the inner face 18*d*, and a resilient latch member 18*j* upstanding in cantilever fashion from inner face 18*d* and including a finger portion 18*k* proximate the free end of the latch member.

Figure 9:
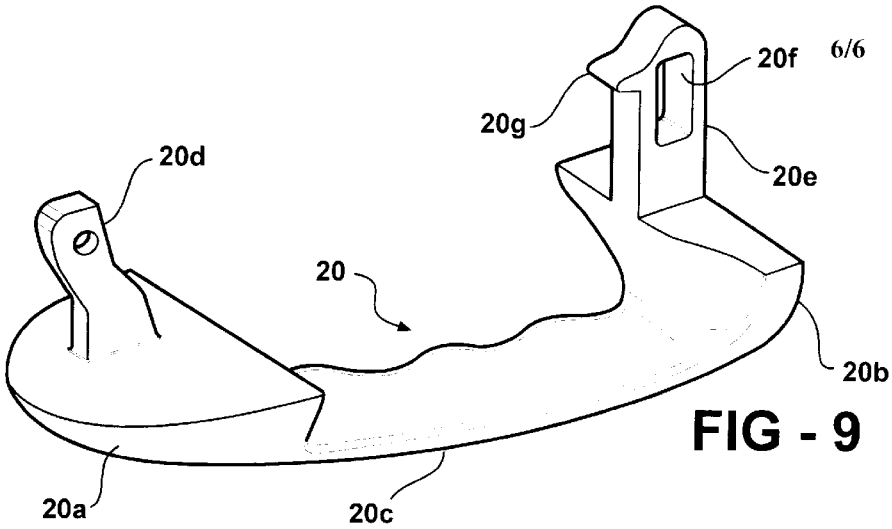
FIG. 9 is a perspective view of the handle of the handle assembly.

Handle 20 (FIG. 9) includes a front end 20*a*, a rear end 20*b*, a main body grasping portion 20*c* extending between front and rear ends 20*a*, 20*b*, a pivot arm 20*d* upstanding from front end 20*a*, and a tower or finger 20*e* upstanding from rear end 20*b* and including an aperture 20*f* and a tang 20*g*.

Pivot arm 20*d* extends upwardly through main body 18*a* of the housing for receipt in pivot structure 18*e*, whereby to pivotally mount the handle on the housing utilizing a suitable pivot pin 30, and tower structure 20*e* extends upwardly through main body portion 18*a* and through guide structure 18*f* to slidably mount the tower structure within the guide structure.

Pivot shaft 22 has a circular cross-sectional configuration and extends between housing lugs 18*g* and 18*h*.

Figure 10:
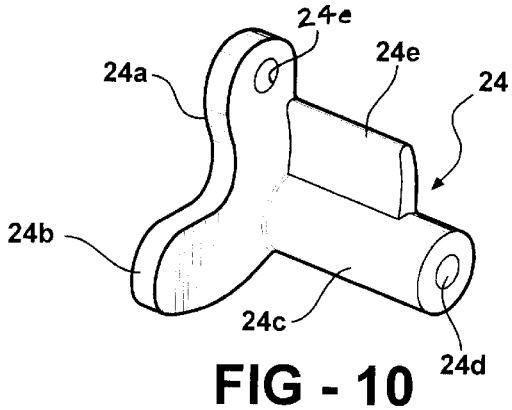
FIG. 10 is a perspective view of a bell crank lever utilized in the handle assembly.

Bell crank lever 24 (FIG. 10) includes a first arm portion 24*a*, a second arm portion 24*b*, a hub portion 24*c* defining a through bore 24*d*, and a flange portion 24*e*. Bell crank 24 is rotatably mounted on shaft 22 proximate housing flange 18*h* with pivot shaft 22 passing through through bore 24*d* and bell crank arm 24*b* positioned within aperture 20*f* of handle tower structure 20*e*. A suitable actuator rod 32 (FIG. 3) is connected at one end thereof to an aperture 24*e* in bell crank arm 24*a* and at another end thereof to a door latch mechanism shown schematically at 33 in FIG. 1, whereby, in known manner, pivotal movement of the bell crank operates to latch and unlatch the latch mechanism 33.

Figure 11:
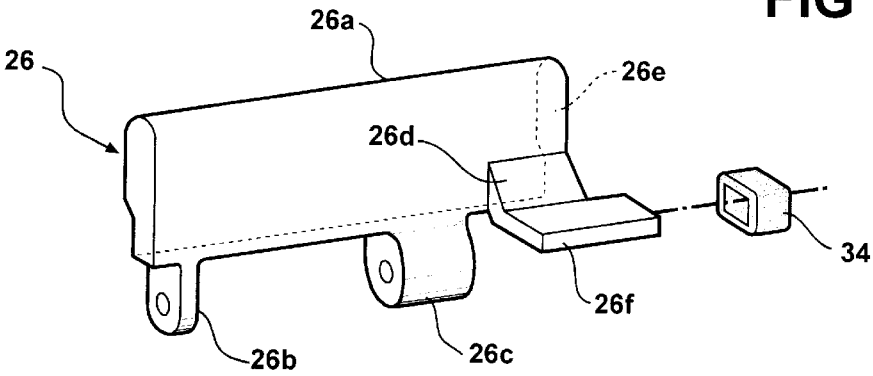
FIG. 11 is a perspective view of the counterweight utilized in the handle assembly.
Figure 12:
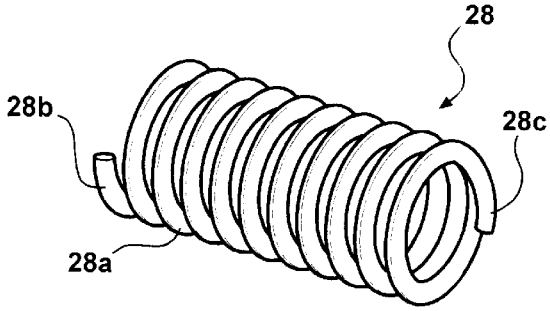
FIG. 12 is a perspective view of a spring utilized in the handle assembly.

Counterweight 26 (FIG. 11) includes a main body portion 26*a* having a generally rectangular cross section, front and rear lug portions 26*b* and 26*c*, and a tang portion 26*d* projecting laterally from main body portion 26*a* proximate the rear face 26*e* of the counterweight. Counterweight 26 is rotatably mounted on pivot shaft 22 between housing lugs 18*g* and 18*h* utilizing lugs 26*b*, 26*c*. Counterweight 26 is positioned on shaft 22 forwardly of bell crank 24 with tang 26*d* positioned for latching coaction with the latch finger portion 18*k* of latch member 18*j*. A tubular cap 34 is fitted over the free rear end 26*f* of tang 26*d* and overlyingly engages the tang 20*g* of the handle tower structure.

Coil spring 28 includes a main body portion 28*a*, a free front end portion 28*b*, and a free rear end portion 28*c*. Spring 28 is mounted on pivot shaft 22 between the rear lug 26*c* of the counterweight and the front end of the hub 24*c* of the bell crank lever with free front end 28*b* bearing against the underside of the main body portion of counterweight 26 and free rear end portion 28*c* bearing against an adjacent surface of the housing 18. Spring 28 thus provides a biasing force tending to rotate counterweight 26 about the axis of shaft 22 and further, in known manner, provides the return spring for the door handle assembly.

Figure 5:
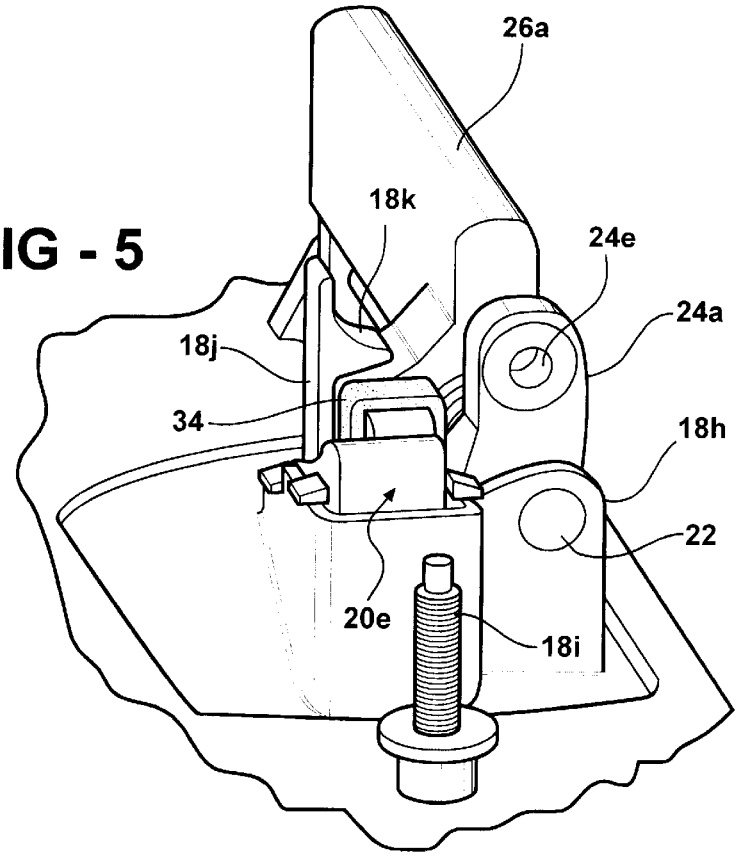
FIG. 5 is a further perspective view of the handle assembly with the counterweight in the installation position.

Preparatory to installing the door handle assembly in door 14, counterweight 26 is positioned in the installation position seen in FIGS. 2, 4, and 5. In this position of the counterweight, the handle is pivoted to an open or unlatching position whereby to pivot the bell crank lever to an unlatching position; the tang 20*g* of the handle tower structure immediately underlies the cap 34 positioned on the free end 26*f* of the tang 26*d* of the counterweight; the tang 26*d* of the counterweight is positioned beneath the finger portion 18*k* of the latch member 18*j* to preclude movement of the counterweight to its operative position; and spring 28 is loaded so as to exert a force via spring end 28*b* against the counterweight attempting to move the counterweight about the axis of pivot shaft 22 to its operative position.

It will be seen that the counterweight in its installation position projects substantially forwardly from the main body of the housing and is within the forward profile of the housing. Accordingly, as seen in FIGS. 2 and 3, the handle assembly may be mounted on the door by passing the handle assembly through the aperture 16*a* in the outer skin 16 of the door to position the main body 18*a* of the housing within the aperture 16*a* and position the operating or actuating mechanisms of the door handle assembly, including the counterweight 26, within the interior of the door, whereafter the handle may be pivoted inwardly about the axis of pin 30 to move tower structure 20*e* upwardly within guide portion 18*f* of the housing. This movement of the handle in a closing or latching direction engages bell crank lever arm portion 24*b* and pivots the bell crank lever about the axis of pivot shaft 22 from the latched position seen in FIG. 2 to the unlatched position seen in FIG. 3.

At the same time, the tang 20*g* of the tower structure 20*e* bears against cap 34 and disengages tang 26*d* from the finger portion 18*k* of latch member 18*j* whereupon loaded spring 28 operates to rotate the counterweight about the axis of pivot shaft 22 to the operative position of the counterweight seen in FIG. 3. In this position, cap 34 bears against the flange portion 24*e* of the bell crank lever so that any attempt of the bell crank lever to rotate about the axis of shaft 22 in a door unlatching direction in response to an impact against the side of the vehicle proximate the door handle assembly is effectively resisted by the pushing action of the counterweight against the bell crank lever, whereby to preclude inadvertent unlatching movement of the door handle assembly in a proximate side impact scenario. Further, and importantly, since the counterweight merely pushes against the bell crank lever, the counterweight is free to move away from the bell crank lever in response to an impact against other aspects of the vehicle such, for example, as the remote side of the vehicle opposite from the door handle assembly so as not to urge the bell crank lever in a door unlatching direction in a remote side impact scenario. This described arrangement of the counterweight will be seen to enable the counterweight to be operative to generate a force resisting movement of the handle mechanism in an unlatching direction and inoperative to generate a force resisting movement of the handle mechanism in a latching direction.

More specifically, the counterweight will be seen to be operative to move with the handle mechanism in response to movement of the handle mechanism in an unlatching direction, whereby to resist unlatching movement of the handle mechanism in response to an impact against a side of the vehicle proximate the handle assembly, and be operative to move independently of the handle mechanism in response to movement of the handle mechanism in a latching direction, whereby to be free to separate from the handle mechanism in response to impact against aspects of the vehicle remote from the handle assembly so as not to act to urge the handle mechanism in a door unlatching direction.

Stated somewhat differently, the counterweight of the invention is operative to resist movement of the handle mechanism in an unlatching direction and is further operative to not resist movement of the handle mechanism in a latching direction.

It will be understood that, following positioning of the door handle assembly within the aperture 16*a*, the handle assembly is suitably fixedly secured to the door utilizing fasteners 18*i* and actuator rod 32 is connected to the arm portion 24*a* of bell crank 24 to operatively connect the handle assembly to the door latch assembly so that opening movement of the handle 20 has the effect of unlatching the door latch to allow opening of the door.

The invention door handle assembly will be seen to provide a counterweight arrangement wherein the counterweight operates to discourage inadvertent unlatching movement of the handle assembly in the event of an impact against a side of the vehicle proximate the door handle assembly but does not operate to encourage inadvertent opening movement of the door handle assembly in response to impacts against other aspects of the vehicle. The invention door handle assembly will further be seen to allow the utilization of a counterweighted door handle assembly in conjunction with an installation procedure wherein the handle assembly is installed on the door by passing the handle assembly through an aperture in the outer skin of the door, thereby combining the effectiveness of the counterweight arrangement in precluding inadvertent unlatching of the door in a side impact scenario with the simplicity and cost efficiencies of installation through an aperture in the outer skin of the door.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A door handle assembly for controlling the latch of a motor vehicle door, the handle assembly comprising:

a housing;

a handle mechanism mounted on the housing for movement in an unlatching direction and in an opposite, latching direction;

a counterweight mounted on the housing for movement inertially in response to a side impact in a direction opposite the direction of inertial movement of the handle mechanism, the counterweight including a surface positioned against a surface on the handle mechanism, the counterweight being mounted such that the counterweight surface pushes inertially against the handle mechanism surface in response to a side impact against the vehicle proximate the door handle assembly, whereby to inertially resist movement of the handle mechanism in an unlatching direction, and such that the counterweight surface is free to move inertially away from the handle mechanism surface in response to an impact against a side of the vehicle remote from the door handle assembly, whereby so as not to act to inertially urge the handle mechanism in a door unlatching direction;

the handle mechanism comprising a handle and an actuator lever mounted for movement about a pivot axis;

the handle mechanism surface being defined on the actuator lever;

the counterweight being mounted for pivotal movement about the pivot axis; and the handle assembly including biasing means operative to push the counter-weight surface against the actuator lever surface.

2. A door handle assembly according to claim 1 wherein the biasing means comprises a coil spring positioned on the pivot axis and urging the counterweight surface for pivotal movement against the actuator lever surface.

3. A door handle assembly according to claim 2 wherein the coil spring further acts to provide a return spring for the handle assembly acting to resiliently resist movement of the handle mechanism in an unlatching direction.

4. A door handle assembly according to claim 1 wherein:

the actuator lever comprises a bell crank lever having a first arm driven by the handle and a second arm connected to the latch mechanism of the door whereby opening movement of the handle unlatches the door;

the handle mechanism surface is defined on the second arm of the bell crank lever; and the biasing means acts to bias the counterweight surface against the surface on the second arm of the bell crank lever.

5. A method of counteracting inadvertent unlatching movement of a motor vehicle door handle assembly in the event of impacts against the vehicle, the method comprising:

providing a housing;

providing a handle mechanism mounted on the housing for movement in an unlatching direction and in an opposite latching direction;

providing a counterweight;

mounting the counterweight on the housing for inertial movement in response to side impact in a direction opposite to the direction of inertial movement of the handle mechanism in response to the side impact;

mounting the counterweight with respect to the handle mechanism such that the counterweight pushes against the handle mechanism rather than being fixed for movement with the handle mechanism;

the handle mechanism comprising a handle and an actuator lever mounted for movement about a pivot axis and driven by the handle and connected to a latch mechanism of the door;

the method including mounting the counterweight for pivotal movement about the pivot axis and arranging the counterweight to push against the lever, whereby to resist movement of the lever and thereby the handle in a door latching direction in response to an impact against the side of the vehicle proximate the door handle assembly while allowing the counterweight to move freely away from the lever so as not to urge the lever and thereby the handle in a door unlatching direction in response to an impact against a side of the vehicle remote from the door handle assembly.

6. A door handle assembly for controlling a latch mechanism of a vehicular door, the handle assembly comprising:

a housing;

a handle mechanism mounted on the housing for movement in an unlatching direction and in an opposite latching direction;

a counterweight operative to resist movement of the handle mechanism in an unlatching direction in response to an impact against the side of the vehicle proximate the handle assembly and inoperative to resist movement of the handle mechanism in a latching direction in response to impacts against other aspects of the vehicle remote from the handle assembly;

the handle mechanism comprising a handle, and an actuator lever mounted for movement about a pivot axis;

the counterweight being mounted for pivotal movement about the pivot axis;

the handle assembly including biasing means operative to push the counterweight against the actuator lever;

the biasing means comprising a coil spring positioned on the pivot axis and urging the counterweight for pivotal movement against the actuator lever; and the coil spring further acting to provide a return spring for the handle assembly acting to resiliently resist movement of the handle mechanism in an unlatching direction.

7. A door handle assembly according to claim 6 wherein:

the actuator lever comprises a bell crank lever having a first arm driven by the handle and a second arm connected to the latch mechanism of the door whereby opening movement of the handle unlatches the door; and the biasing means acts to bias the counterweight against the second arm of the bell crank lever.

* * * * *

UNITED STATES PATENT AND TRADEMARK OFFICE

CERTIFICATE OF CORRECTION

PATENT NO. : 6,575,508 B2 
DATED : June 10, 2003
INVENTOR(S) : David R. Stuart et al.

It is certified that error appears in the above-identified patent and that said Letters Patent is hereby corrected as shown below:

Title page,
Item [75], Inventors, should read:
-- [75] Inventors: David R. Stuart, Middleville, MI (US);
Michael Boorsma, Grandville, MI (US);
Christian M. Norton, Wixom, MI (US);
David B. Lehmkuhl, Dearborn, MI (US); and
James L. Salmon; Ann Arbor, MI (US) --

Signed and Sealed this

Thirteenth Day of January, 2004

JON W. DUDAS
*Acting Director of the United States Patent and Trademark Office*